US010610026B2

(12) United States Patent
Miller et al.

(10) Patent No.: US 10,610,026 B2
(45) Date of Patent: Apr. 7, 2020

(54) FOLDABLE, STAND-ALONE MATTRESS WITH INTERNAL SPRING SYSTEM

(71) Applicants: John Edward Miller, Tupelo, MS (US); John Edward Miller, III, Saltillo, MS (US)

(72) Inventors: John Edward Miller, Tupelo, MS (US); John Edward Miller, III, Saltillo, MS (US)

( * ) Notice: Subject to any disclaimer, the term of this patent is extended or adjusted under 35 U.S.C. 154(b) by 238 days.

(21) Appl. No.: 15/886,036

(22) Filed: Feb. 1, 2018

(65) Prior Publication Data

US 2018/0228296 A1 Aug. 16, 2018

Related U.S. Application Data

(60) Provisional application No. 62/459,087, filed on Feb. 15, 2017.

(51) Int. Cl.
*A47C 23/05* (2006.01)
*A47C 23/00* (2006.01)
*A47C 17/13* (2006.01)

(52) U.S. Cl.
CPC ..... *A47C 23/005* (2013.01); *A47C 17/138* (2013.01); *A47C 23/007* (2013.01); *A47C 23/05* (2013.01)

(58) Field of Classification Search
CPC ... A47C 23/005; A47C 17/138; A47C 23/007; A47C 23/05; A47C 23/002; A47C 23/34
USPC ..... 5/722
See application file for complete search history.

(56) References Cited

U.S. PATENT DOCUMENTS 4,489,450 A * 12/1984 Miller ..... A47C 23/005 5/12.1
4,620,336 A * 11/1986 Miller ..... A47C 23/005 5/249
4,654,905 A * 4/1987 Miller ..... A47C 23/005 5/249
4,872,227 A * 10/1989 Galumbeck ..... A47C 23/04 5/246
5,539,944 A * 7/1996 Miller ..... A47C 17/22 267/103
7,487,564 B2 2/2009 Miller
2006/0150326 A1* 7/2006 Miller ..... A47C 17/40 5/136

OTHER PUBLICATIONS

European search report dated May 24, 2018 mailed in corresponding European application No. 18155065.8.

* cited by examiner

*Primary Examiner* — Eric J Kurilla
*Assistant Examiner* — James T Coble
(74) *Attorney, Agent, or Firm* — Kirchstein, Israel, Schiffmiller & Pieroni, P.C.

(57) ABSTRACT

An internal spring system resiliently supports a mattress in an item of furniture. The spring system includes a system of sinuous springs arranged between upper and lower wire grids. A movable extender assembly is mounted on the grids to accommodate a longitudinal shift between the upper and lower grids during folding of the spring system between open and closed positions.

8 Claims, 13 Drawing Sheets

FOLDABLE, STAND-ALONE MATTRESS WITH INTERNAL SPRING SYSTEM

BACKGROUND

This disclosure generally relates to a stand-alone mattress having an internal spring system and foldable between an open position in which a user is resiliently supported, and a closed position in which the mattress and the spring system are compactly stored in an item of furniture.

It is generally known that foldaway or foldable beds are attractive bedding options for persons with restricted living space, such as are commonly found in recreational vehicles, trailers, boats, studio apartments, and the like. A Murphy-style bed includes a mattress that can be swung or folded into a wall-mounted cabinet or closet when not being used for sleeping. A convertible foldable bed folds upon itself, either one or two times, for compact storage to serve as a sofa or seating area, and then is unfolded into a bed for sleeping. The convertible sofa-bed includes a mattress that is sufficiently flexible to fold upon itself, and that is supported and deployed by an articulated bed frame.

Although generally satisfactory for their intended purposes, the known foldable beds have exhibited some drawbacks. For maximum sleeping comfort. the mattress is desired to be relatively firm and thick. However, a thick, firm mattress is not readily foldable, and particularly not in furniture of contemporary style where a low seat height and small dimensions are aesthetically desirable. In foldaway beds, a thick mattress requires a deeper cabinet or closet, thereby encroaching on the already limited living space. Where style and space requirements are paramount, a thin, foldable, soft and easily crushable mattress is employed; however, the result is often an unsatisfactory, uncomfortable sleeping surface.

To solve the aforementioned problems, several internal spring systems within mattresses have been developed, the systems being foldable for compact storage and being unfoldable for resiliently supporting a person during use. Reference can be made, for example, to such earlier U.S. patents as, namely, U.S. Pat. Nos. 4,489,450; 4,654,905; 4,620,336; 5,184,809; 5,431,376; 5,535,460; 5,539,940; 5,539,944; 5,540,418; 5,524,305; 5,642,536; 5,655,240; 7,487,564; 7,726,636; and No. 7,979,930.

As exemplified by some of these patents, each internal spring system has an upper wire grid located below, and in close proximity with, an upper mattress face; a lower wire grid located above, and in close proximity with, a lower mattress face; and a plurality of generally planar, sinuous springs, each pivotably connected at its opposite ends to the upper and lower grids. When the mattress is in the open or body-supporting position, the sinuous springs stand vertically upright in parallel planes generally parallel to head and foot end faces of the mattress, and resiliently hold the upper and lower grids apart. However, as the mattress is folded to the closed or storage position, the pivotable springs pivot about the grids and lie in inclined planes; and, at the same time, the upper and lower grids shift longitudinally and are drawn closer together, thereby decreasing the distance between the upper and lower mattress surfaces and decreasing the thickness of the mattress so that it can be compactly stored within the furniture cabinet or closet in the closed position.

Experience has shown, however, that the longitudinal shift between the upper and lower grids is disadvantageous, because this shift must be accommodated in the mattress itself, as well as in the furniture cabinet or closet. For example, if the upper and lower grids have the same length as considered lengthwise or longitudinally of the mattress, then the upper grid would shift longitudinally forwardly during movement to the closed position. The shifted upper grid occupies more space that would undesirably increase the interior space required within the furniture cabinet or closet.

In addition, the known mattresses having such sinuous springs have a tendency to collapse in the open position, that is, they cannot readily stand erect by themselves without having to somehow anchor it to a support outside the mattress to maintain vertical stability, and/or by using internal webbing straps to resist such collapse.

BRIEF SUMMARY

One feature of this disclosure resides, briefly stated, in a foldable, stand-alone mattress having an internal spring system movable between an open position in which a user is resiliently supported, and a closed position in which the spring system is compactly stored in an internal storage compartment of an item of furniture, for example, a foldaway or foldable bed, convertible sofa-bed, or like motion furniture. The spring system includes an upper wire grid located below, and in close proximity with, an upper mattress face; a lower wire grid located above, and in close proximity with, a lower mattress face; and a plurality of sinuous springs, each pivotably connected at its upper and lower ends to the upper and lower grids for movement between the open or body-supporting position in which the user may, for example, lie down on the mattress for sleeping in a generally horizontal orientation, and the closed or storage position in which the mattress is compactly stored in the furniture. In the open position, the grids are resiliently held and spaced apart by the sinuous springs, which are standing vertically upright. In the closed position, the grids lie adjacent one another in close proximity, and the sinuous springs lie in inclined planes. During movement from the open to the closed position, the upper grid shifts longitudinally forwardly relative to the lower grid, as considered lengthwise of the mattress. Conversely, during movement from the closed to the open position, the upper grid shifts longitudinally rearwardly relative to the lower grid.

The rearward shift of the upper grid is disadvantageous, because, among other things, the upper, outer edge region at the foot of the mattress will not be that well supported. When one sits at the foot of the mattress, the upper, outer edge region would yield undesirably, and the mattress would sag at this region. The forward shift of the upper grid is also disadvantageous, because the shifted upper grid occupies more space that would undesirably increase the internal storage compartment required within the furniture.

In accordance with one feature of this disclosure, a movable extender assembly is mounted on the spring system. A top extender is mounted for movement on the upper grid. The top extender is retractable rearwardly relative to the upper grid, while the upper grid is simultaneously extendable forwardly relative to the lower grid, during movement from the open to the closed position. Thus, the forward shift of the upper grid is matched by the rearward shift of the top extender, and no extra space needs to be provided in the internal storage compartment. Analogously, the top extender is extendable forwardly relative to the upper grid, while the upper grid is simultaneously shifted rearwardly relative to the lower grid, during movement from the closed to the open position. The extended top extender effectively fills in that space vacated by the rearward shift of the upper grid so that the mattress is reliably supported at its upper, outer edge region at the foot of the mattress. When one sits on the upper, outer edge region at the foot of the mattress, the extended top extender resists any undesirable yielding or sagging of the mattress at this region. The movable extender assembly can also be located at the head of the mattress.

In accordance with another feature of this disclosure, the tendency of such a mattress having such sinuous springs to collapse in the open position is minimized, by providing a transition section transversely across a width of the mattress. The transition section is supported on an internal sub-frame having a pair of pivotably interconnected frame portions. A plurality of yieldable elements or hinges is advantageously spaced along the transition section to provide a yieldable surface for the mattress at the transition section.

DETAILED DESCRIPTION

The present disclosure is generally related to furniture, particularly motion furniture in which a body-supporting component thereof, for example, a mattress, a cushion, a pad or the like, is moved, typically between a closed or storage position in which the body-supporting component is stored at least partially within the furniture, and an open or use position in which the body-supporting component resiliently supports a user's body. For ease of illustration and description, this disclosure is described for use in a foldaway or foldable bed in which the mattress is generally horizontal in its open or unfolded position to serve as a support for a sleeping occupant, and is folded over itself at least once, for compact storage in the closed position in a sofa-bed convertible item of furniture. However, it will be expressly understood that this disclosure, especially as it relates to the structure, function and operation of a spring system located within the mattress can be used in other items of furniture that are not beds, such as fold-down seats. It should also be understood that the term furniture is not restricted to items found in one's house, but can equally well apply to items on recreational vehicles, trailers, boats and the like. In addition, the present disclosure is also directed to the body-supporting component itself, especially a foldable, stand-alone mattress that can readily stand erect by itself.

Figure 1:
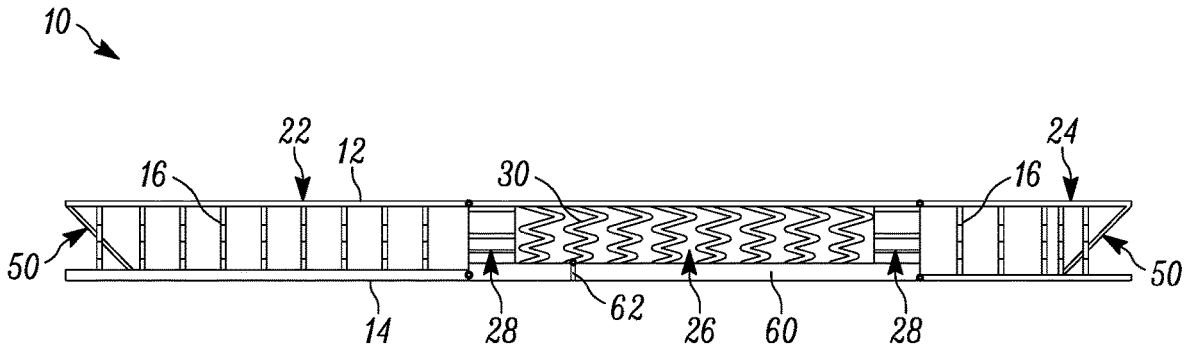
FIG. 1 is a side view of a foldable spring system in isolation in an open position in accordance with this disclosure.
Figure 2:
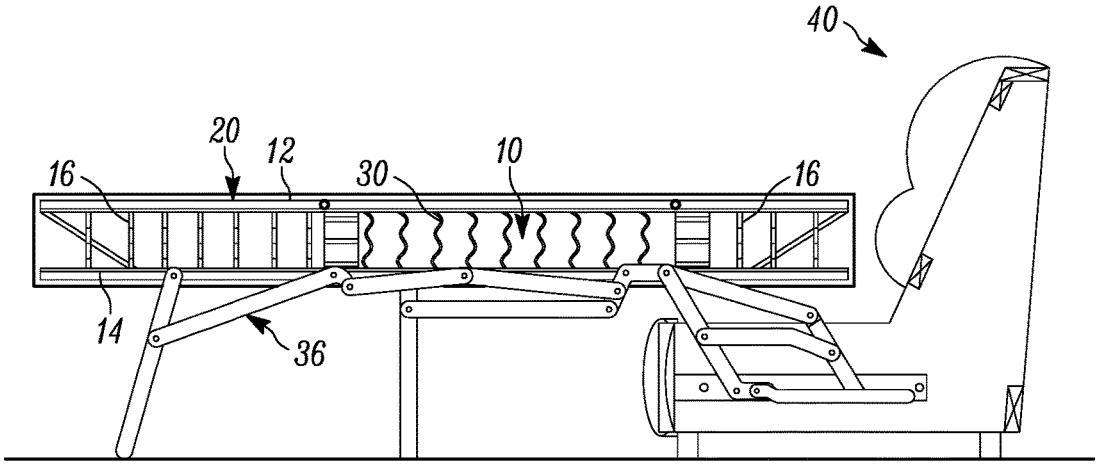
FIG. 2 is a side view of the spring system of FIG. 1 mounted internally of a mattress that is mounted on a sofa-bed in the open position.
Figure 3:
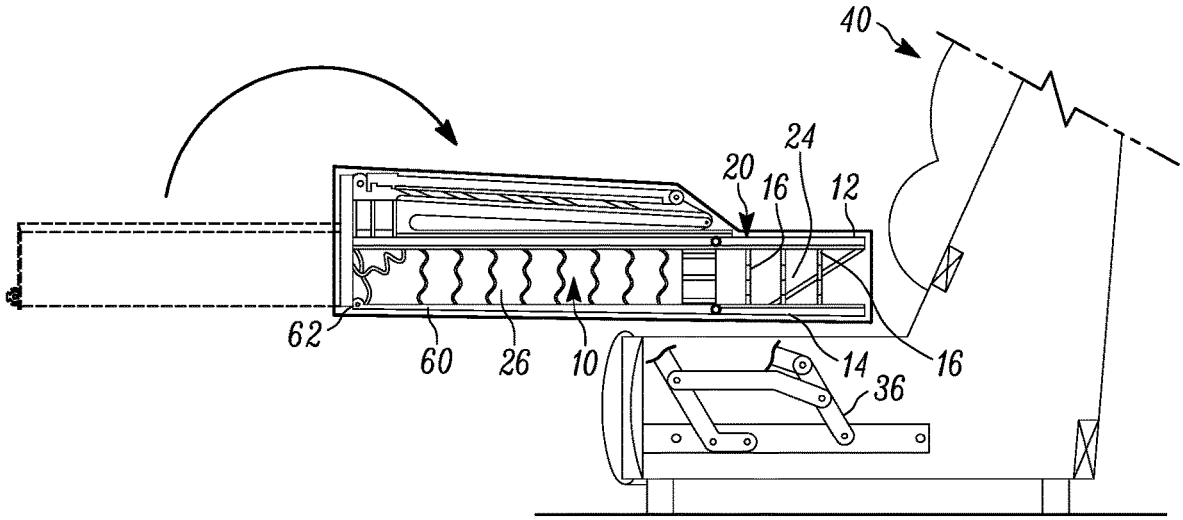
FIG. 3 is a side view of the mattress and bed of FIG. 2 during at an intermediate stage of folding the spring system to a partially closed position.
Figure 4:
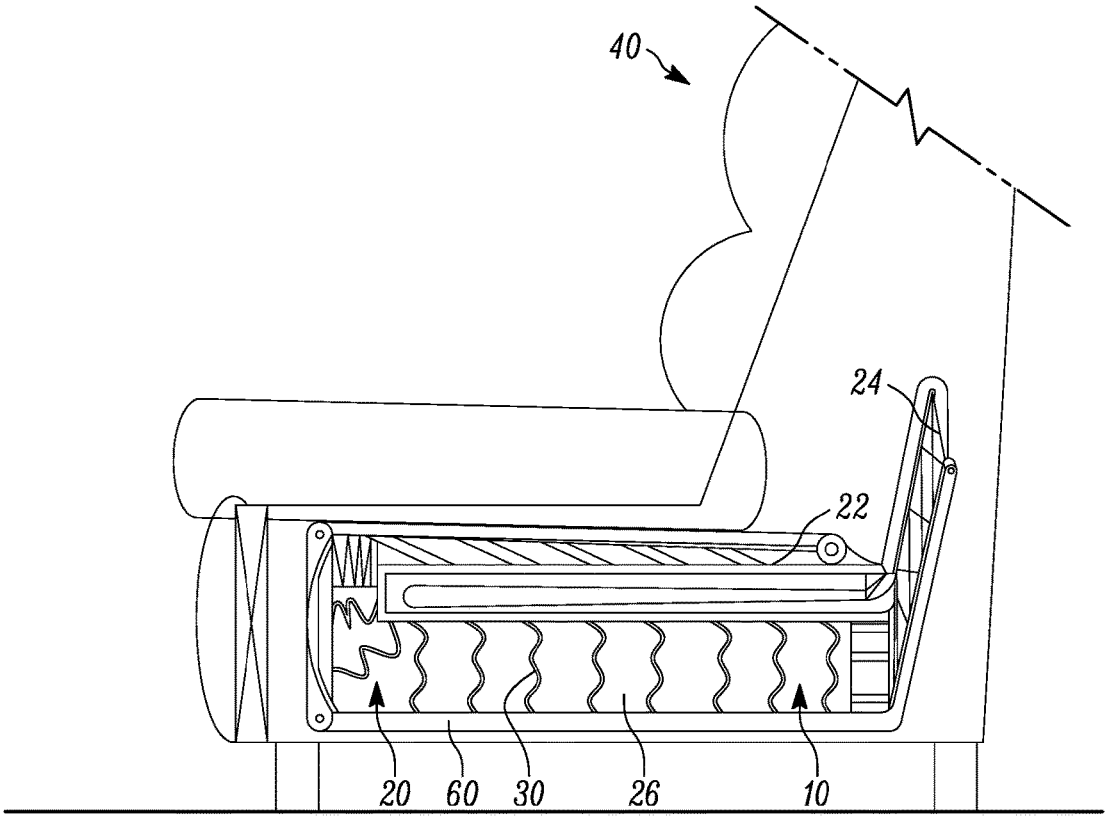
FIG. 4 is a side view of the mattress and bed of FIG. 3 in a fully closed position.

Turning to FIG. 1 of the drawings, a spring system 10 is shown in isolation in an open position. As shown in FIG. 2, the spring system 10 is mounted internally within a mattress 20 underneath padding (not illustrated), such as foam, latex, cotton, rubber, feathers, batting, or the like. As shown in FIGS. 2-4, the internal spring system 10 and the mattress 20 are foldable from an open or horizontal body-supporting position (FIG. 2); to an intermediate, single-folded, partially closed position (FIG. 3); and then to a final, double-folded, fully closed or storage position (FIG. 4) in which the spring system 10 and the mattress 20 are stored in an internal cavity of an item of furniture 40. The internal spring system 10 and the mattress 20 are unfoldable to the open position in reverse order.

The spring system 10 includes an upper wire grid 12 located below, and in close proximity with, an upper mattress face; a lower wire grid located above, and in close proximity with, a lower mattress face; and a plurality of generally planar, sinuous springs 16, each pivotably connected at its upper and lower ends to the grids 12, 14 for movement between the closed or collapsed position (see FIGS. 4-5) in which the sinuous springs 16 lie in inclined planes with the grids 12, 14 lying closely adjacent one another, and the open or upright position (see FIGS. 1, 6) in which the grids 12, 14 are resiliently held and spaced apart by the sinuous springs 16 that generally lie in mutual parallel vertical planes.

Figure 5:
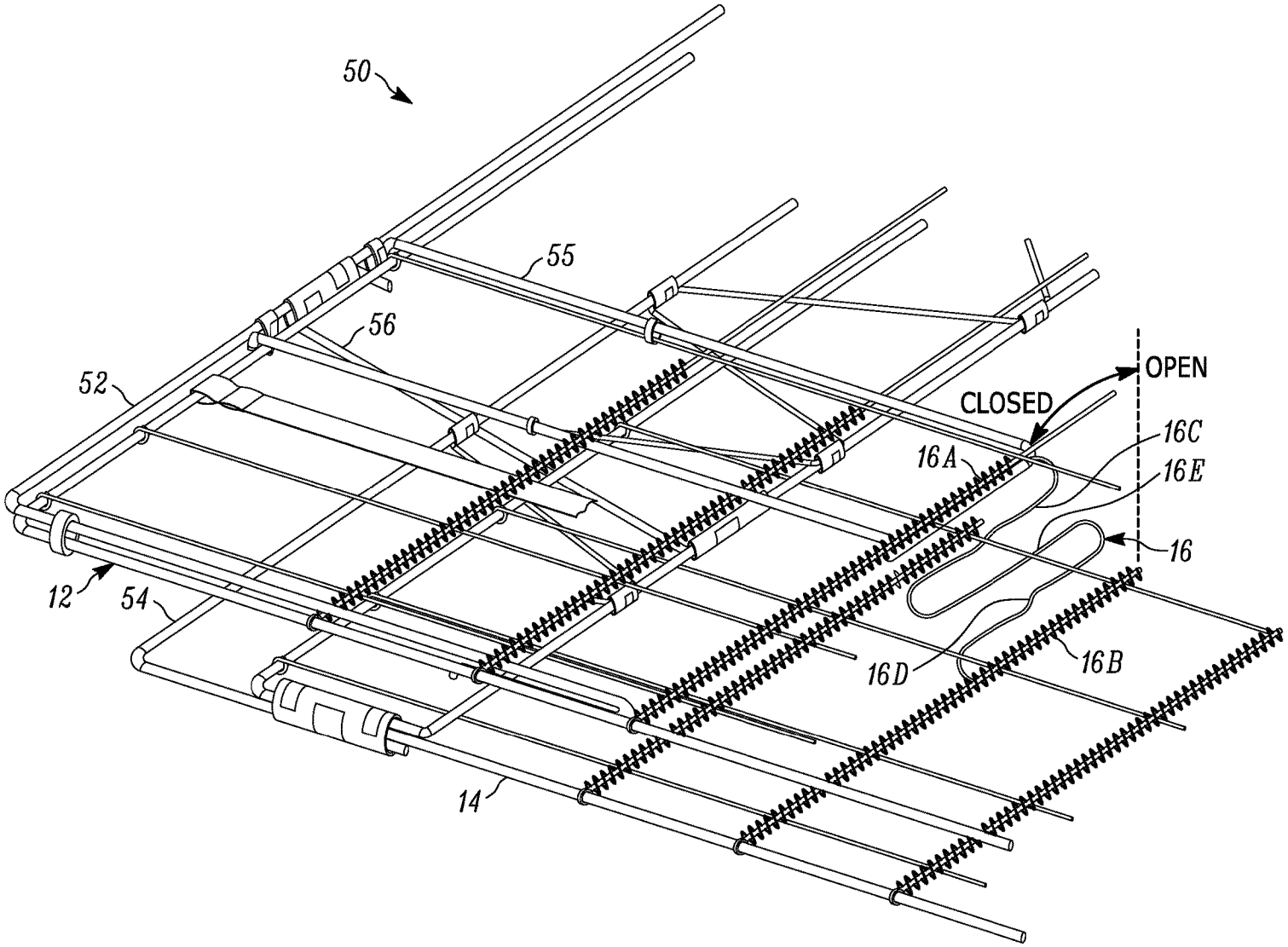
FIG. 5 is a broken-away, enlarged, perspective view of an extender assembly mounted on the spring system of FIG. 1 in the closed position, in accordance with this disclosure.
Figure 10:
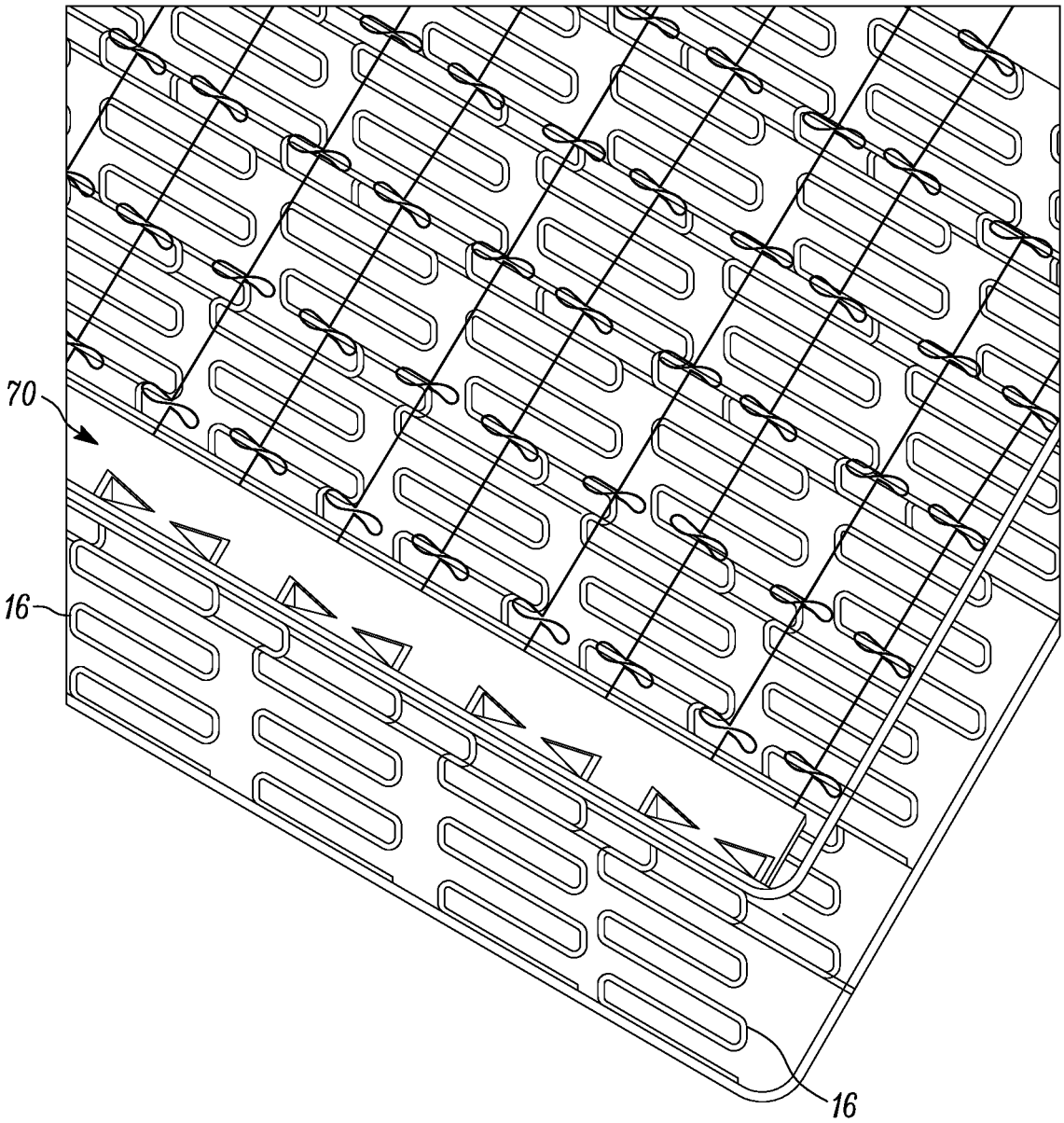
FIG. 10 is a broken-away, front, perspective view of the spring system of FIG. 1, together with a banding strip.
Figure 11:
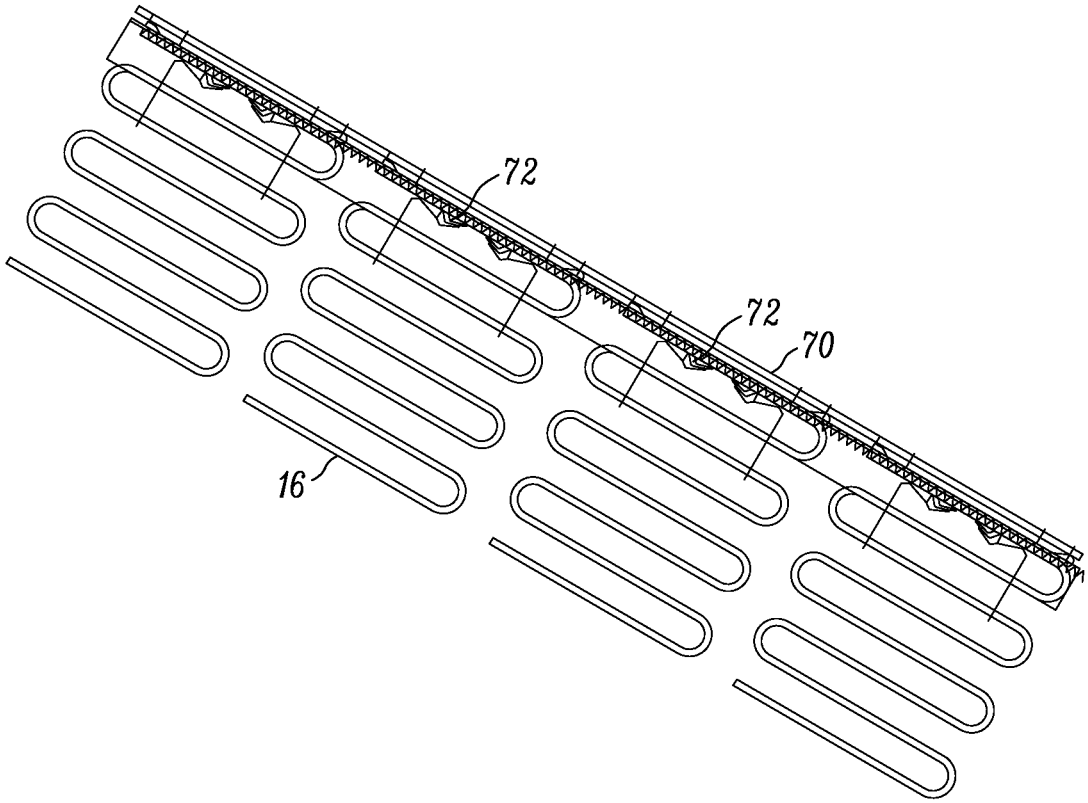
FIG. 11 is a side view of the banding strip of FIG. 10.

As shown in FIG. 1, the spring system 10 has a foot section 22, a head section 24, an intermediate or body section 26, and at least one transition section 28, and, as illustrated, two transition sections 28. Preferred embodiments of each transition section 28 are described below in connection with FIGS. 7-8. The sinuous springs 16 are provided in the foot and head sections 22, 24, while an array of different springs, e.g., conventional Bonnell-type coil springs 30, is provided in the intermediate section 26. As shown in FIGS. 5, 10, and 11, each sinuous spring 16 is a single length of sinuous wire formed into an upper linear run 16A, a lower linear run 16B, an upper offset run 16C connected to the upper linear run 16A by an arcuate portion, a lower offset run 16D connected to the lower linear run 16B by an arcuate portion, and a central linear run 16E connected to the offset runs 16C, 16E by arcuate portions.

Figure 7:
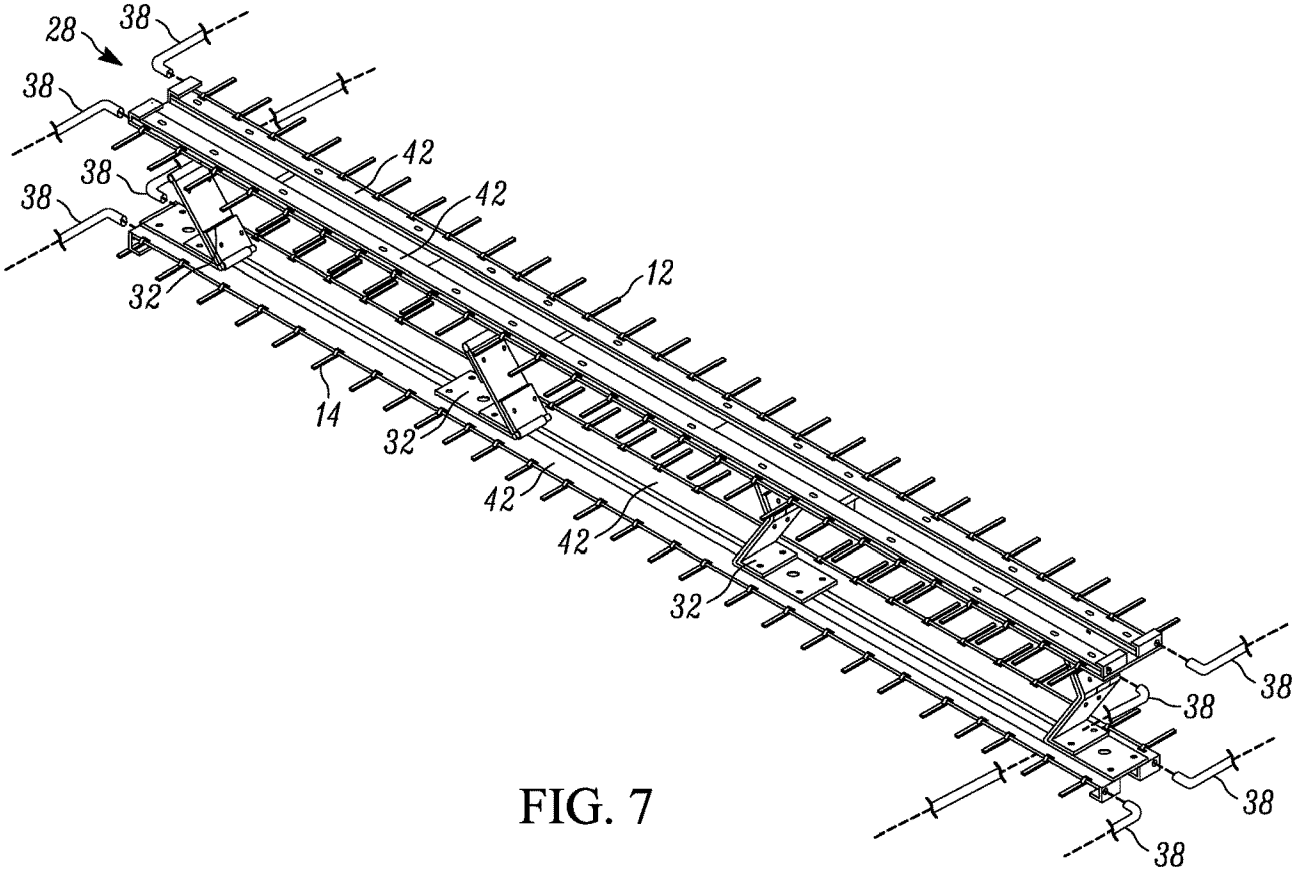
FIG. 7 is a broken-away, enlarged, perspective view of one embodiment of a transition section mounted on the spring system of FIG. 1, in the open position.
Figure 7A:
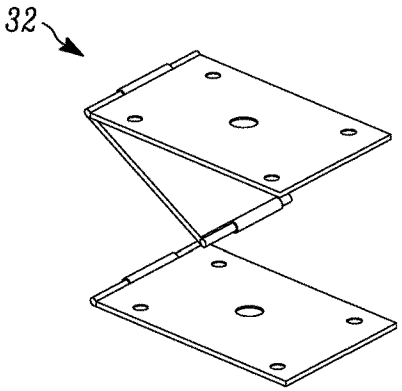
FIG. 7A is an enlarged, perspective view of a hinge of FIG. 7 in isolation.
Figure 8:
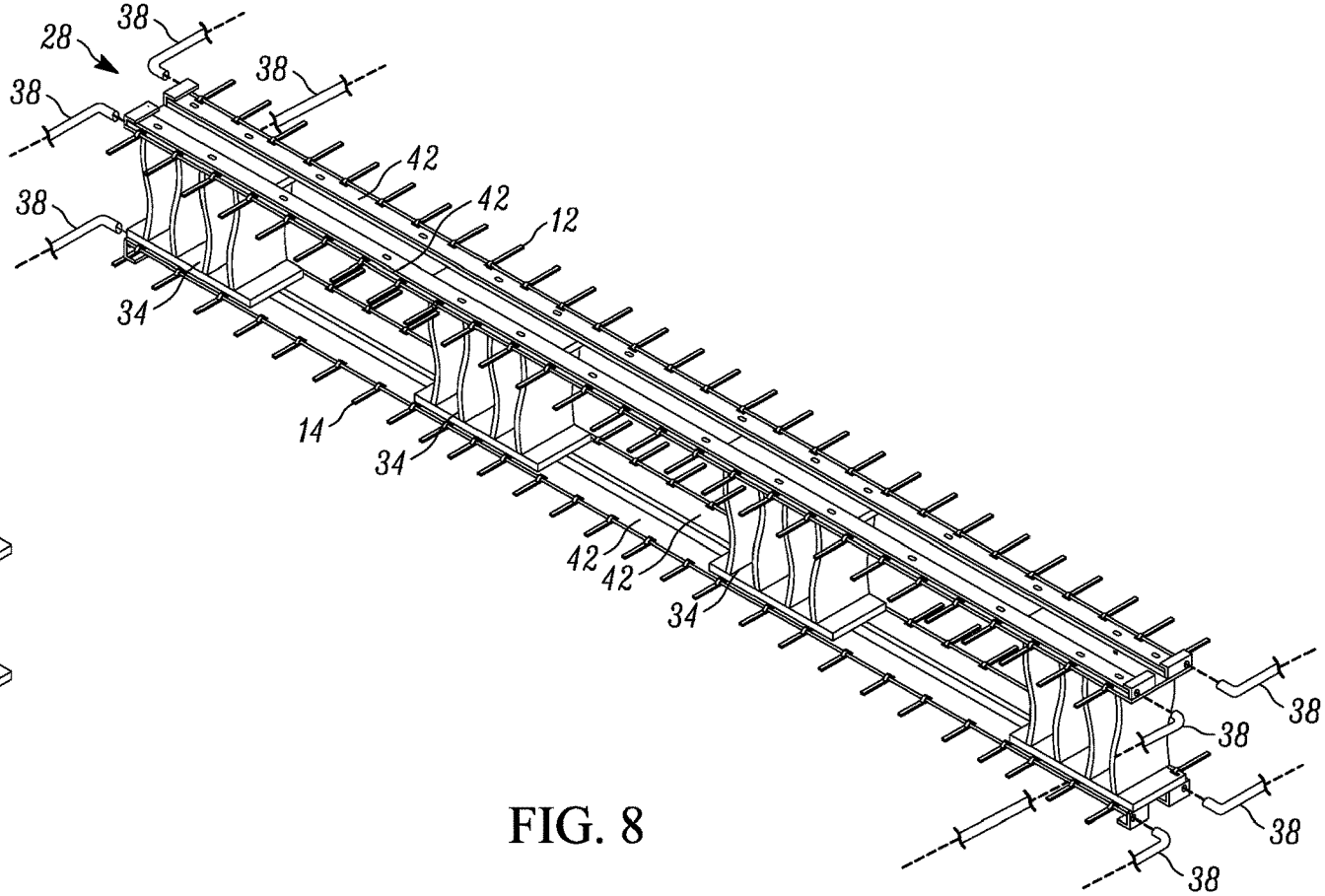
FIG. 8 is a broken-away, enlarged, perspective view of another embodiment of a transition section mounted on the spring system of FIG. 1, in the open position.
Figure 8A:
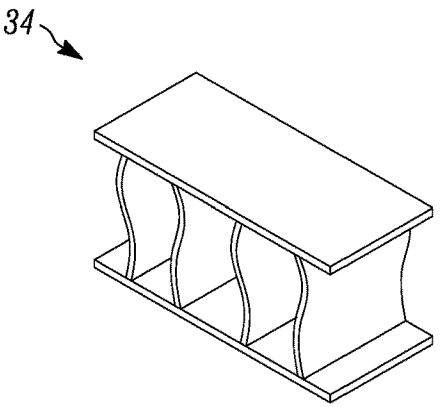
FIG. 8A is an enlarged, perspective view of a hinge of FIG. 8 in isolation.
Figure 9A:
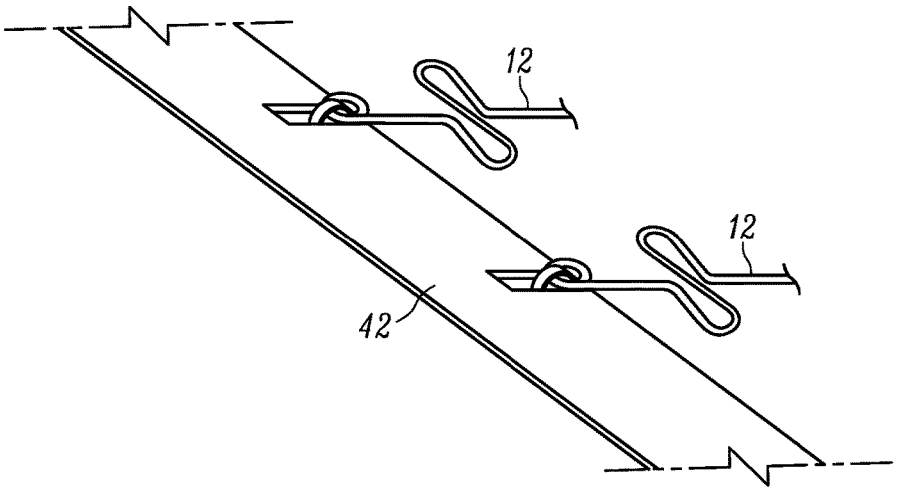
FIGS. 9A-9D are broken-away, perspective views of multiple embodiments of a detail of how the upper and lowers grids may be connected to the transition section of FIGS. 7 and 8.
Figure 9B:
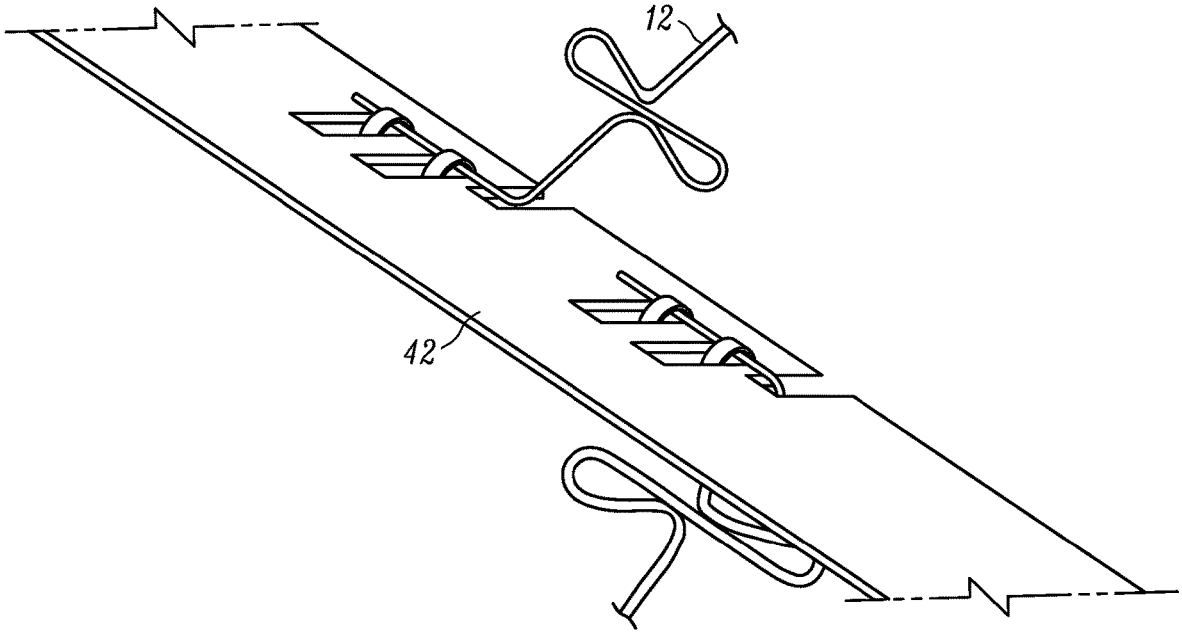
Figure 9C:
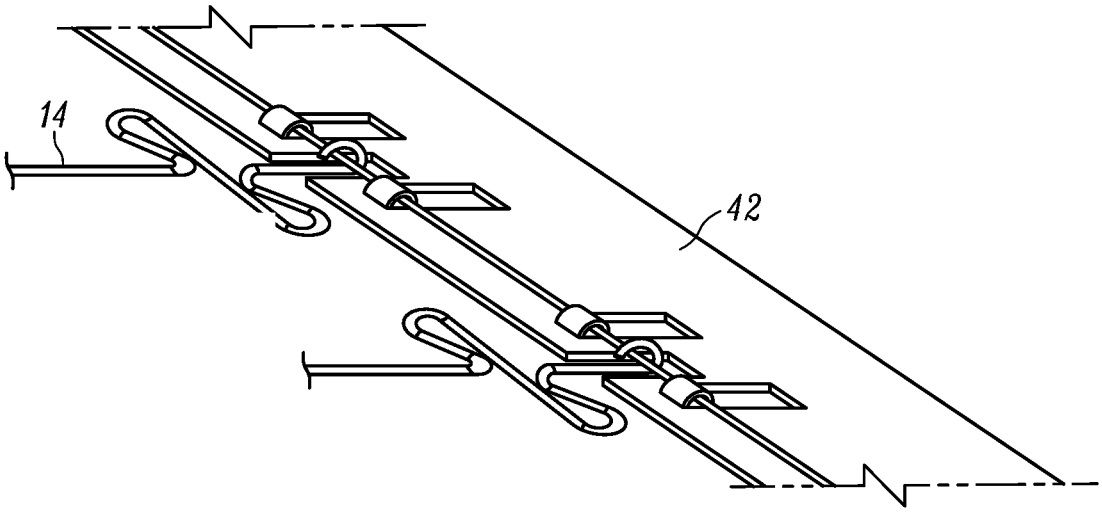
Figure 9D:
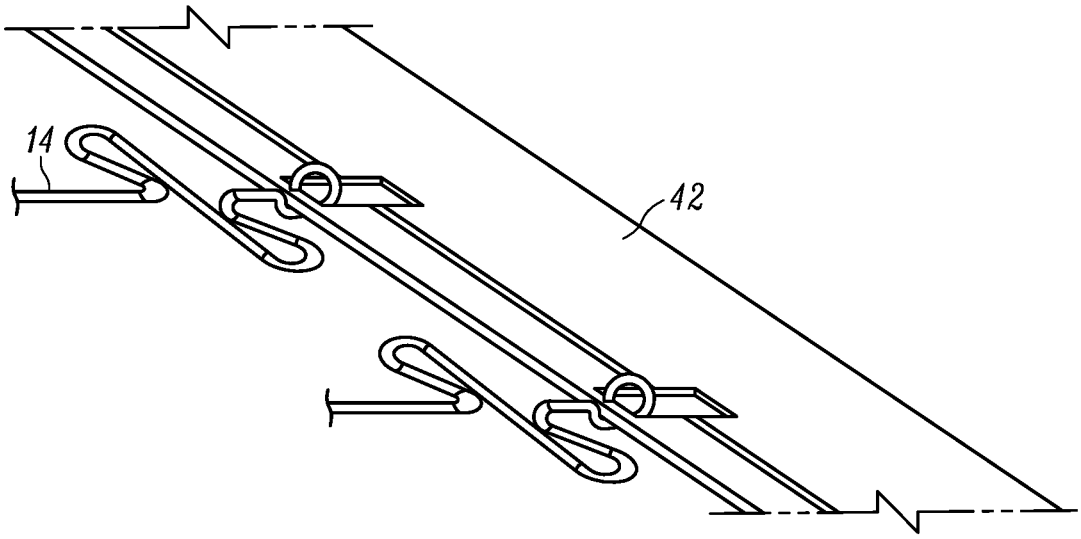

FIG. 7 illustrates one embodiment of the transition section 28 having a plurality of one type of hinge 32 (see FIG. 7A) spaced apart of each other along a pair of upper and lower, elongated rails or supports 42. The upper supports 42 may be configured as plates and may be integral with each other and form a single support or plate. Likewise, the lower supports 42 may be configured as plates and may be integral with each other and form a single support or plate. Each hinge 32 may include hinged metal pieces or a plastic living hinge with a return memory. FIG. 8 illustrates another embodiment of the transition section 28 having a plurality of another type of hinge 34, e.g., a plastic spring having deflection resistance and a return memory. As before, each pair of the supports or plates 42 may be integral with each other and form a single support or plate.

FIGS. 9A-9D show different ways in which the upper and lower grids 12, 14 may be attached to the supports or plates 42 of each transition section 28. In addition, the upper and lower grids 12, 14 may be attached to the supports or plates 42 by helical springs that extend lengthwise of the supports or plates 42. FIGS. 7 and 8 also illustrate that a pair of separate upper border wires 38 are pivotably attached to each upper support 42, and that a pair of separate lower border wires 38 are pivotably attached to each lower support 42, thereby allowing the separate border wires 38 to be pivoted and to lie flat against each other during folding movement to the closed position. Heretofore, border wires were not used on such foldable mattresses, because a single rigid border wire extending around the periphery of the mattress prevented such folding movement.

FIG. 1 also shows a sub-frame 60, preferably in two frame sections hinged together at pivot 62. Each frame section is rigid and may be configured from wood or metal. The lower supports or plates 42 of each transition section 28 serve as a rigid base fixedly secured to the sub-frame 60, for example, with screws. The transition section 28 extends transversely across the width of the mattress 20 and serves to resist the mattress 20 from undesirably collapsing in the body-supporting position, that is, the mattress 20 can readily stand erect by itself without having to anchor it to a support outside the mattress 20 to maintain vertical stability, and/or without using internal webbing straps to resist such collapse.

The aforementioned Bonnell-type coil springs 30 have their lower ends fixedly connected to the sub-frame 60, for example, with hog rings. When the foot section 22 is folded over as shown in FIG. 3, the front frame section of the sub-frame 60 determines the height of an interior compartment of the furniture or sofa-bed 40 in which the mattress 20 is to be stored. As best seen in FIG. 2, an articulating linkage 36 is connected to the sub-frame 60 to enable folding movement into the interior compartment of the sofa-bed 40.

Figure 6:
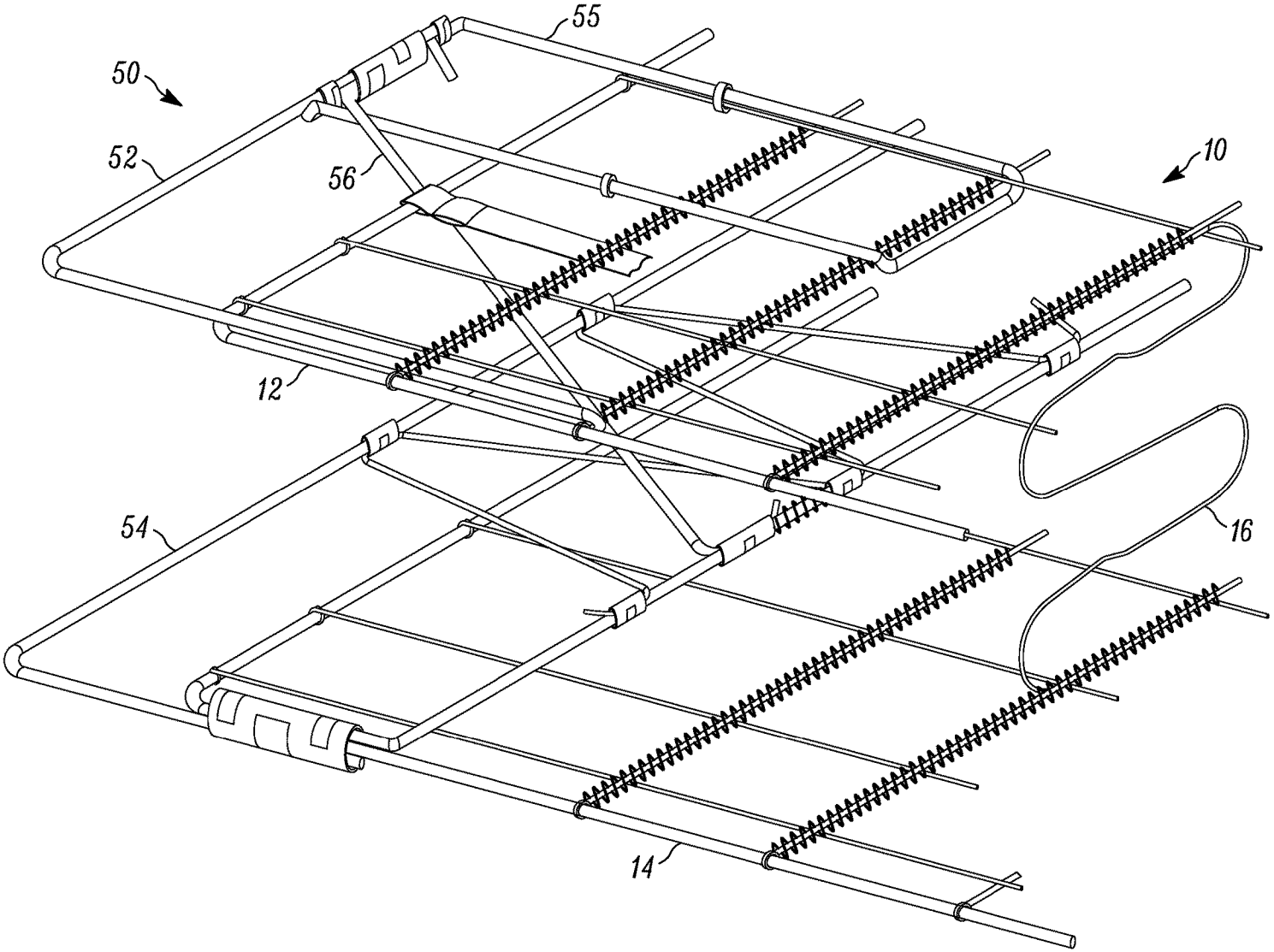
FIG. 6 is a view analogous to FIG. 5, but with the extender assembly in the open position, in accordance with this disclosure.

In accordance with this disclosure, as shown in FIGS. 5-6, a movable extender assembly 50 is mounted on the spring system 10 at the foot section 22 and/or at the head section 24. As described above, during folding movement of the spring system 10 from its open to its closed position, the upper grid 12 shifts longitudinally forwardly relative to the lower grid 14. This shift is disadvantageous, because it results, among other things, in a longer mattress than is necessary, with a concomitant increase in the size of the interior compartment of the sofa-bed to accommodate this larger mattress, as well an unsupported upper, outer edge region of the mattress 10 at the foot section 22 and/or at the head section 24.

The extender assembly 50 provides such support and minimizes the size of the mattress. The extender assembly 50 includes a top, generally U-shaped, border wire 52 that extends transversely along the entire width of the mattress and that also extends partially lengthwise of the mattress, and a plurality of top, generally rectangular, wire sections 55. Only one rectangular wire section 55 is shown in FIGS. 5-6, but it will be understood that the plurality of such rectangular wire sections 55 are spaced apart of one another transversely of the mattress. A representative wire section 55 is shown in isolation in FIGS. 13A-13C. The top border wire 52 and the plurality of rectangular wire sections 55 together constitute a top extender that is mounted for sliding, telescopic movement on the upper grid 12 for movement between an extended position (see FIG. 6) in the open position of the spring assembly 10, and a retracted position (see FIG. 5) in the closed position of the spring assembly 10. The extender assembly 50 includes a bottom, generally U-shaped, border wire extender 54 that is fixedly mounted on the lower grid 14, and an actuator wire rod 56 that has one end pivotally mounted on the top border wire 52, and an opposite end pivotally mounted on the bottom extender 54 and the lower grid 14. The actuator rod 56 in FIGS. 5-6 is a control link and may be configured as a linear wire between its opposite ends. The actuator rod 56 pulls the top border wire 52 rearwardly until it substantially overlies the upper grid 12 in the closed position of FIG. 5, and pushes the top border wire 52 forwardly until it substantially overlies the lower grid 14 in the open position of FIG. 6.

Put another way, the actuator rod 56 pushes the top border wire 52 and the rectangular wire sections 55 forwardly while the upper grid 12 is simultaneously being shifted rearwardly, thereby insuring that the opposite faces of the mattress are fully supported in the open position. The extended top border wire 52 and the rectangular wire sections 55 effectively fill in that space vacated by the rearward shift of the upper grid 12 so that the mattress is reliably supported at its upper, outer edge region. When one sits on the upper, outer edge region, either at the foot or the head, of the mattress, the extended top border wire 52 and the rectangular wire sections 55 resist any undesirable yielding or sagging of the mattress at these regions. The sliding rectangular wire sections 55 bridge and use the resistance of not only one of the springs 16 at the upper, outer edge region, but may bridge and tie multiple springs 16 together, thereby providing even greater edge support.

This general bridging method can also be used in the intermediate section 26 having the Bonnell springs 30 by wedging and attaching a rectangular wire from under the edge of an inboard spring 30, bridging across its top to and across a top of its neighboring outside spring 30 and fastening together with a steel clip. The outside edge of the intermediate section 26 is firmer, because it ties together two springs 30, instead of one spring 30, for firmness. If these rectangular wires are attached to the outside edge of each row of outside Bonnell springs 30, then downward firmness is gained, and a top surface is prevented from imploding due to any center weight, as it does with a non-folding border wire encased in residential mattresses. This general non-telescopic attaching and clipping to the outside edge creating paired springs, allows the mattress rows of springs to fold, but to resist imploding, and provides increased edge support.

It is known to anchor internal webbing straps to a frame to maintain vertical stability of the mattress. In accordance with this disclosure, one or more internal transition sections 28 are attached to the sub-frame 60, or to a wire, wood, or steel internal grid. This gives the mattress internal vertical stability that now allows the mattress to be portable if needed, and to stand erect by itself, i.e., a stand-alone mattress, without having to somehow anchor it to a support outside the mattress to maintain vertical stability.

Figure 10A:
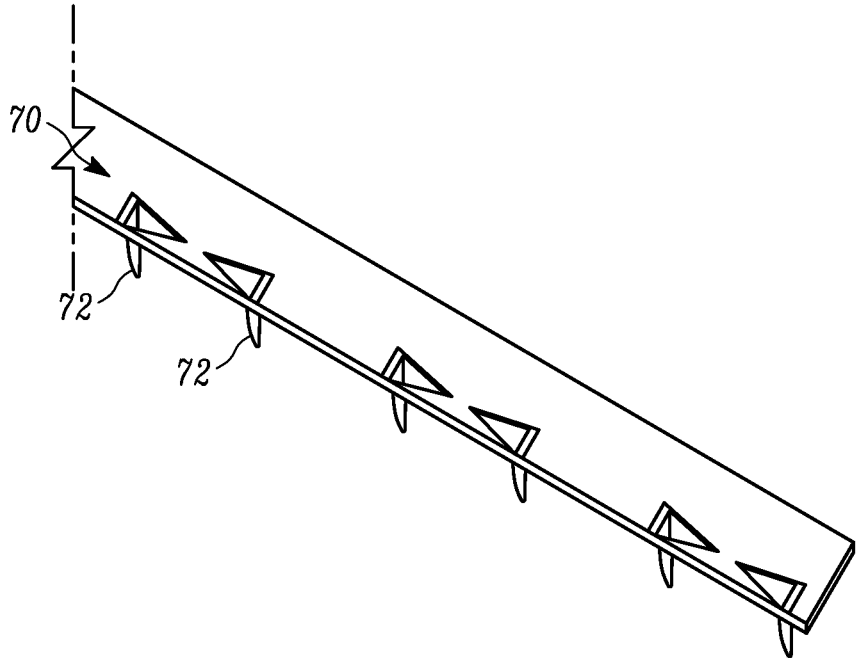
FIG. 10A is a broken-away, perspective view of the banding strip of FIG. 10 in isolation.
Figure 12A:
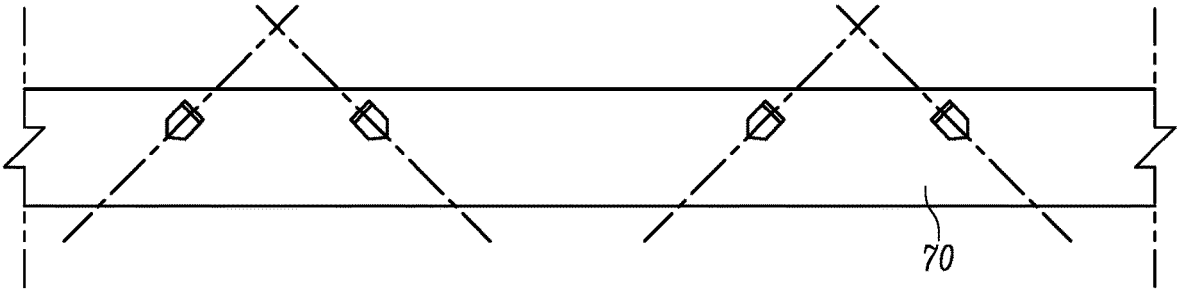
FIGS. 12A, 12B, 12C are a set of views of a modified banding strip in isolation.
Figure 12B:
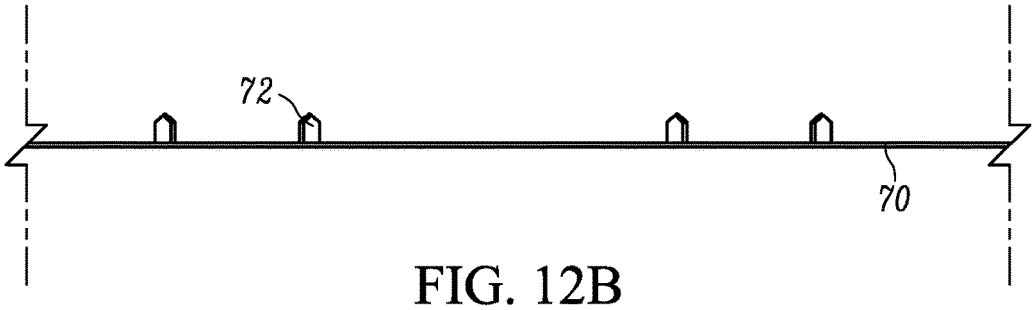
Figure 12C:
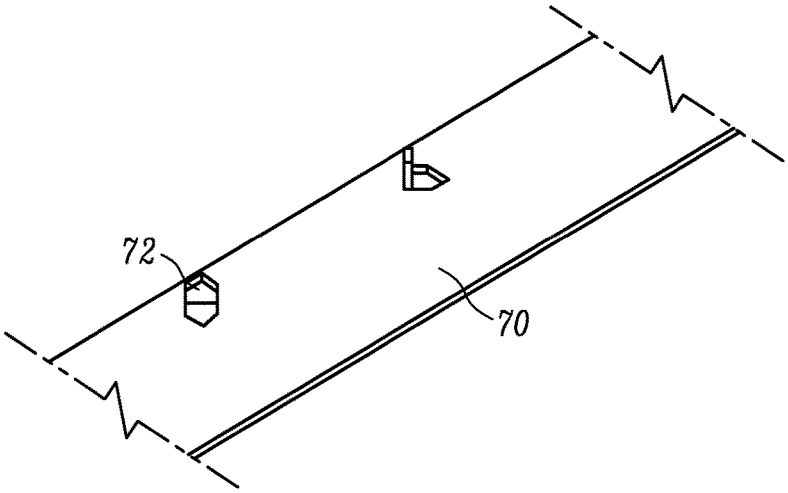

FIGS. 10, 10A and 11 depict a flat flexible piece of banding plate 70 that has bent tabs 72 sticking out of its bottom surface. The tabs 72 are inserted into eyelet openings at the top surface of the spring system. The banding plate 70 helps to prevent the top surface of the mattress from distorting due to pressure exerted from the top edge inward, from either the foot or head direction. The banding plate 70 can be inserted or attached across the foot or head edge, or across the mid-section of the mattress to prevent distortion at the top surface, but yet allows for up and down deflection. FIGS. 12A-12C depict a modified banding plate 70.

Figure 13A:
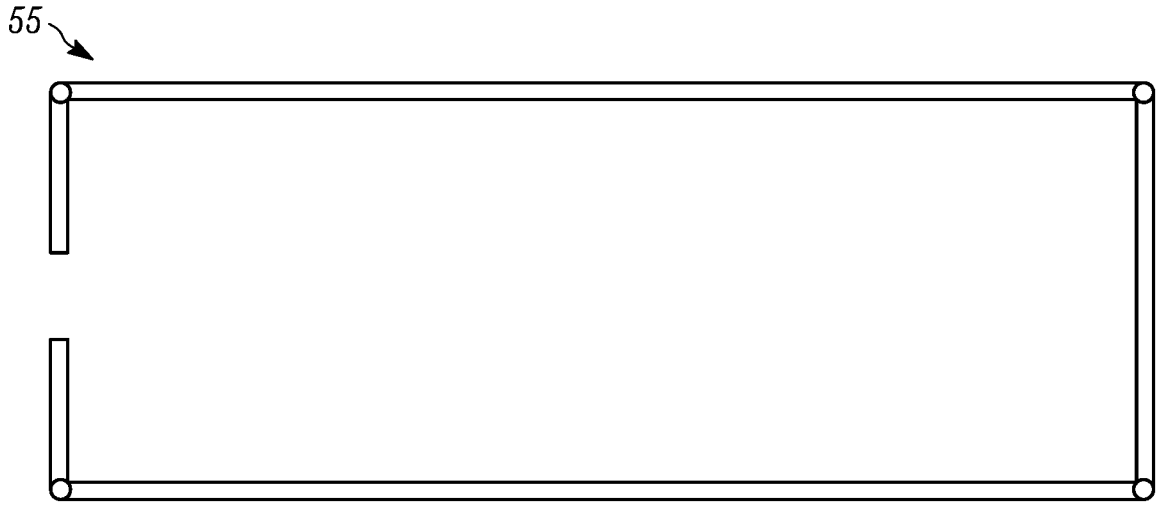
FIGS. 13A, 13B, 13C are a set of views of a detail of the top extender.
Figure 13B:
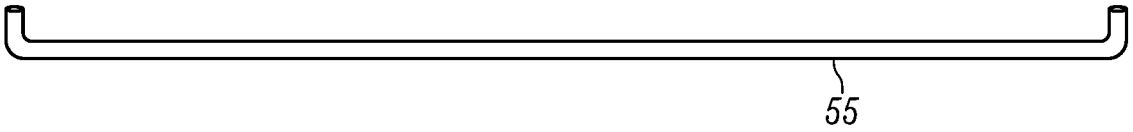
Figure 13C:
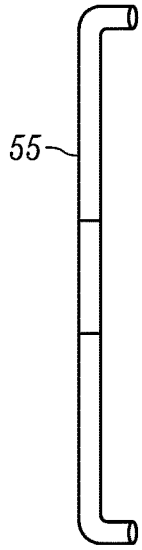
Figure 14:
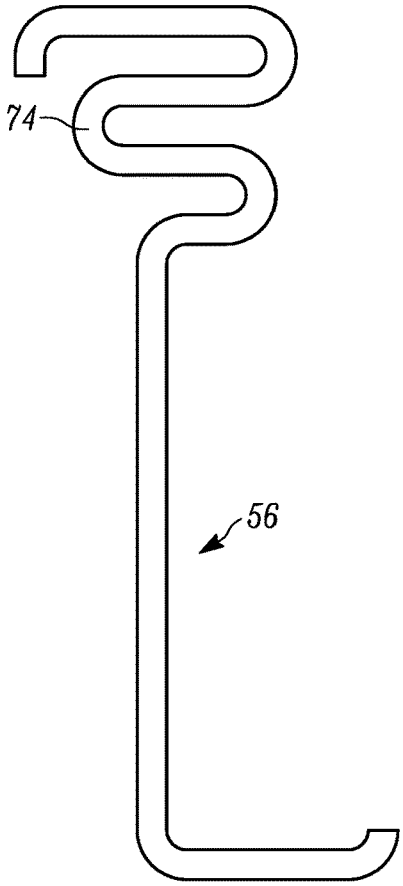
FIG. 14 is an enlarged, plan view of a modified actuator rod.

FIGS. 13A-13C are views of the top border wire extender 55 in isolation. FIG. 14 is a modified actuator wire rod 56 or push-pull control link that will compress and expand back to its original length when reacting to overhead weight. The modified actuator rod 56 of FIG. 14 has sinuous loops 74 to absorb deflection resulting from an overhead weight, yet it will achieve its pushing and pulling control.

The invention claimed is:

1. A stand-alone mattress foldable between open and closed positions, comprising:

an internal spring system mounted within the mattress and having an upper wire grid, a lower wire grid, and a plurality of sinuous springs pivotably connected to the grids for movement between the closed position in which the springs lie in inclined planes with the grids lying adjacent one another, and the open position in which the springs lie in upright planes and resiliently hold the grids apart;

an internal transition section mounted within the mattress and including an upper support extending transversely of the mattress and connected to the upper grid, a lower support extending transversely of the mattress and connected to the lower grid, and a plurality of hinges spaced apart from one another transversely of the mattress and located between, and connected to, the upper and lower supports; and an internal, rigid sub-frame on which the transition section is mounted, for resisting undesirable movement of the springs in the open position, the rigid sub-frame being mounted within the mattress.

2. The mattress of claim 1, wherein the sub-frame has a pair of frame portions pivotably connected together.

3. The mattress of claim 1, and a pair of upper border wire portions pivotably connected to the upper support, and a pair of lower border wire portions pivotably connected to the lower support, each pair of border wire portions being pivotable during folding of the mattress between the open and closed positions.

4. The mattress of claim 1, and a generally planar banding plate lying across the upper grid and having a plurality of tabs for connecting the banding plate to the upper grid.

5. A stand-alone mattress foldable between open and closed positions, comprising:

an internal spring system having an upper wire grid, a lower wire grid, and a plurality of sinuous springs pivotably connected to the grids for movement between the closed position in which the springs lie in inclined planes with the grids lying adjacent one another, and the open position in which the springs lie in upright planes and resiliently hold the grids apart;

an internal transition section including an upper support extending transversely of the mattress and connected to the upper grid, a lower support extending transversely of the mattress and connected to the lower grid, and a plurality of hinges spaced apart from one another transversely of the mattress and located between, and connected to, the upper and lower supports;

an internal, rigid sub-frame on which the transition section is mounted, for resisting undesirable movement of the springs in the open position; and a movable extender assembly mounted on the spring system, the assembly including a top extender mounted for movement between extended and retracted positions on the upper grid, a bottom extender fixedly mounted on the lower grid, and an actuator that has one end pivotally connected to the top extender, and an opposite end pivotally connected to the bottom extender; and wherein the actuator pulls the top extender to the retracted position until the top extender substantially overlies the upper grid in the closed position, and pushes the top extender to the extended position until top extender substantially overlies the lower grid in the open position.

6. The mattress of claim 5, wherein the actuator is a wire having a linear portion and a sinuous portion.

7. A mattress foldable between open and closed positions, comprising:

an internal spring system having an upper wire grid, a lower wire grid, and a plurality of sinuous springs pivotably connected to the grids for movement between the closed position in which the springs lie in inclined planes with the grids lying adjacent one another, and the open position in which the springs fie in upright planes and resiliently hold the grids apart; and a movable extender assembly mounted on the spring system, the assembly including a top extender mounted for movement between extended and retracted positions on the upper grid, a bottom extender fixedly mounted on the lower grid, and an actuator that has one end pivotally connected to the top extender, and an opposite end pivotally connected to the bottom extender, the actuator pulling the top extender to the retracted position until the top extender substantially overlies the upper grid in the closed position, and pushing the top extender to the extended position until top extender substantially overlies the lower grid in the open position.

8. The mattress of claim 7, wherein the actuator is a wire having a linear portion and a sinuous portion.

* * * * *